US007258275B1

(12) United States Patent
Reddy

(10) Patent No.: US 7,258,275 B1
(45) Date of Patent: Aug. 21, 2007

(54) TELEVISED COMPETITION VIEWER VOTING MODIFIED SCORING METHODOLOGY

(76) Inventor: Steven David Reddy, 193 Woodside Crossing, Enfield, CT (US) 06082

( * ) Notice: Subject to any disclaimer, the term of this patent is extended or adjusted under 35 U.S.C. 154(b) by 28 days.

(21) Appl. No.: 11/138,976

(22) Filed: May 25, 2005

Related U.S. Application Data

(60) Provisional application No. 60/574,260, filed on May 25, 2004.

(51) Int. Cl.
*G07B 15/02* (2006.01)

(52) U.S. Cl. ..... 235/384

(58) Field of Classification Search ..... 705/12; 235/386, 384
See application file for complete search history.

(56) References Cited

U.S. PATENT DOCUMENTS 6,763,338 B2 * 7/2004 Kirshenbaum ..... 706/12
2002/0091564 A1 * 7/2002 Geller ..... 705/12
2006/0068818 A1 * 3/2006 Leitersdorf et al. ..... 455/466

* cited by examiner

*Primary Examiner*—Michael G. Lee
*Assistant Examiner*—Jamara A. Franklin

(57) ABSTRACT

An improved method of tabulating votes cast by audiences of "Reality TV" shows in which contestants are competing with each other during a series of such shows, with one contestant ultimately being determined the winner. The method does this by systematically factoring into the tabulation process votes from prior voting sessions in addition to votes cast during the current voting session, resulting in a modified voting tally. Such modified tally will place more importance on average voting results over several voting sessions and less importance on the current voting session, thereby placing greater emphasis on the consistency of each contestant's voting tallies and therefore the consistency of their performances from one show to the next. Such improved method may result in a greater likelihood that the contestant with the greatest popularity with television viewers over the entire life of the series will be determined the ultimate winner of the television series contest.

6 Claims, 2 Drawing Sheets

102

| contestant | week 1 | week 2 | week 3 | week 4 | week 5 | week 6 | week 7 | week 8 | week 9 | week 10 | week 11 |
|---|---|---|---|---|---|---|---|---|---|---|---|
| 3 | 12.5% | 14.1% | 16.0% | 15.2% | 14.4% | 18.1% | 22.2% | 25.9% | 31.1% | 35.9% | 53.1% |
| 1 | 13.4% | 12.5% | 8.3% | 12.9% | 14.9% | 11.7% | 11.8% | 20.9% | 22.5% | 32.1% | 46.9% |
| 5 | 10.2% | 8.8% | 12.1% | 14.3% | 12.8% | 19.6% | 16.8% | 19.6% | 26.6% | 32.0% | |
| 4 | 11.9% | 12.7% | 8.9% | 8.1% | 9.9% | 13.1% | 17.6% | 17.5% | 19.8% | | |
| 9 | 5.5% | 6.6% | 7.5% | 9.2% | 12.0% | 15.9% | 20.0% | 16.1% | | | |
| 2 | 13.2% | 11.7% | 12.5% | 12.5% | 17.5% | 13.0% | 11.6% | | | | |
| 10 | 4.4% | 3.7% | 8.0% | 8.3% | 9.6% | 8.6% | | | | | |
| 7 | 7.5% | 5.5% | 10.0% | 11.5% | 8.9% | | | | | | |
| 6 | 8.3% | 11.7% | 9.5% | 8.0% | | | | | | | |
| 8 | 6.1% | 9.9% | 7.2% | | | | | | | | |
| 11 | 4.2% | 2.8% | | | | | | | | | |
| 12 | 2.8% | | | | | | | | | | |
| | 100.0% | 100.0% | 100.0% | 100.0% | 100.0% | 100.0% | 100.0% | 100.0% | 100.0% | 100.0% | 100.0% |

102

| contestant | week 1 | week 2 | week 3 | week 4 | week 5 | week 6 | week 7 | week 8 | week 9 | week 10 | week 11 |
|---|---|---|---|---|---|---|---|---|---|---|---|
| 3 | 12.5% | 14.1% | 16.0% | 15.2% | 14.4% | 18.1% | 22.2% | 25.9% | 31.1% | 35.9% | 53.1% |
| 1 | 13.4% | 12.5% | 8.3% | 12.9% | 14.9% | 11.7% | 11.8% | 20.9% | 22.5% | 32.1% | 46.9% |
| 5 | 10.2% | 8.8% | 12.1% | 14.3% | 12.8% | 19.6% | 16.8% | 19.6% | 26.6% | 32.0% | |
| 4 | 11.9% | 12.7% | 8.9% | 8.1% | 9.9% | 13.1% | 17.6% | 17.5% | 19.8% | | |
| 9 | 5.5% | 6.6% | 7.5% | 9.2% | 12.0% | 15.9% | 20.0% | 16.1% | | | |
| 2 | 13.2% | 11.7% | 12.5% | 12.5% | 17.5% | 13.0% | 11.6% | | | | |
| 10 | 4.4% | 3.7% | 8.0% | 8.3% | 9.6% | 8.6% | | | | | |
| 7 | 7.5% | 5.5% | 10.0% | 11.5% | 8.9% | | | | | | |
| 6 | 8.3% | 11.7% | 9.5% | 8.0% | | | | | | | |
| 8 | 6.1% | 9.9% | 7.2% | | | | | | | | |
| 11 | 4.2% | 2.8% | | | | | | | | | |
| 12 | 2.8% | | | | | | | | | | |
| | 100.0% | 100.0% | 100.0% | 100.0% | 100.0% | 100.0% | 100.0% | 100.0% | 100.0% | 100.0% | 100.0% |

FIG. 1

210

| contestant | week 1 | week 2 | week 3 | week 4 | week 5 | week 6 | week 7 | week 8 | week 9 | week 10 | week 11 |
|---|---|---|---|---|---|---|---|---|---|---|---|
| 3 | 12.5% | 14.1% | 16.0% | 15.2% | 14.4% | 18.1% | 22.2% | 25.9% | 31.1% | 35.9% | 53.1% |
| 5 | 10.2% | 8.8% | 12.1% | 14.3% | 12.8% | 19.6% | 16.8% | 19.6% | 26.6% | 32.0% | 46.9% |
| 2 | 13.2% | 11.7% | 12.5% | 12.5% | 17.5% | 13.0% | 11.6% | 20.9% | 22.5% | 32.1% | |
| 6 | 8.3% | 11.7% | 9.5% | 8.0% | 12.0% | 15.9% | 20.0% | 16.1% | 19.8% | | |
| 4 | 11.9% | 12.7% | 8.9% | 8.1% | 9.9% | 13.1% | 17.6% | 17.5% | | | |
| 1 | 13.4% | 12.5% | 8.3% | 12.9% | 14.9% | 11.7% | 11.8% | | | | |
| 7 | 7.5% | 5.5% | 10.0% | 11.5% | 8.9% | 8.6% | | | | | |
| 8 | 6.1% | 9.9% | 7.2% | 8.3% | 9.6% | | | | | | |
| 9 | 5.5% | 6.6% | 7.5% | 9.2% | | | | | | | |
| 10 | 4.4% | 3.7% | 8.0% | | | | | | | | |
| 11 | 4.2% | 2.8% | | | | | | | | | |
| 12 | 2.8% | | | | | | | | | | |
| | 100.0% | 100.0% | 100.0% | 100.0% | 100.0% | 100.0% | 100.0% | 100.0% | 100.0% | 100.0% | 100.0% |
| | | 204 | 10 by 8 | 9 by 6 | 8 by 7 | | 1 by 2 | 4 by 6 | | 2 by 5 | |

202

220

| contestant | week 1 | week 2 | week 3 | week 4 | week 5 | week 6 | week 7 | week 8 | week 9 | week 10 | week 11 |
|---|---|---|---|---|---|---|---|---|---|---|---|
| 3 | 12.5% | 13.6% | 14.9% | 15.0% | 14.9% | 16.3% | 19.0% | 22.4% | 28.1% | 34.4% | 53.1% |
| 5 | 10.2% | 9.2% | 10.8% | 12.3% | 12.8% | 16.0% | 16.7% | 18.2% | 22.9% | 30.3% | 46.9% |
| 2 | 13.2% | 12.2% | 12.3% | 12.4% | 14.6% | 14.2% | 13.2% | 16.4% | 20.4% | 29.1% | |
| 6 | 8.3% | 10.6% | 10.0% | 9.1% | 10.3% | 12.8% | 16.3% | 16.9% | 18.6% | | |
| 4 | 11.9% | 12.5% | 10.6% | 9.5% | 9.4% | 10.9% | 14.1% | 16.1% | | | |
| 1 | 13.4% | 12.8% | 10.4% | 11.5% | 12.9% | 12.6% | 12.4% | | | | |
| 7 | 7.5% | 6.1% | 8.2% | 9.6% | 9.6% | 9.3% | | | | | |
| 8 | 6.1% | 8.7% | 7.9% | 8.1% | 8.8% | | | | | | |
| 9 | 5.5% | 6.3% | 6.9% | 7.9% | | | | | | | |
| 10 | 4.4% | 3.9% | 6.1% | | | | | | | | |
| 11 | 4.2% | 3.2% | | | | | | | | | |
| 12 | 2.8% | | | | | | | | | | |
| | 100.0% | 99.1% | 98.1% | 95.5% | 93.4% | 92.1% | 91.7% | 90.1% | 90.1% | 93.8% | 100.0% |

FIG. 2

TELEVISED COMPETITION VIEWER VOTING MODIFIED SCORING METHODOLOGY

CROSS-REFERENCE TO RELATED APPLICATIONS

This application claims the benefit of PPA Ser. No. 60/574,260 filed on May 25, 2004 by the present inventor.

FEDERALLY SPONSORED RESEARCH

None

SEQUENCE LISTING

None

BACKGROUND OF THE INVENTION

1. Field of the Invention

This invention relates to the process of tabulating votes cast by the television audience for a "Reality TV" show for the express purpose of determining the proper ranking of the show's contestants, and hence, the determination of each of their respective survivals or dismissals from such show.

2. Background of the Invention

The "Reality TV" series American Idol has quickly risen in popularity over the past two years, and has recently been ranked as the most popular show on television according to certain television ratings services. The show features young vocalists from around the United States who compete in a series of sing-offs that ultimately results in the next "American Idol". The contestants are chosen through a series of auditions at selected locations around the country, who then congregate in Hollywood for a series of televised competitions. A panel of three judges whittles the group down to 12 finalists, who will then enter the final rounds in which one contestant at a time is eliminated by a nationwide vote of viewers (generally one each week).

The nationwide vote is generally held in the two hour period immediately following that week's singing performances, with voting results then tabulated and announced the following night. The votes are done by phone or text messaging, with special dial in numbers announced immediately before the voting period begins. Generally only the order of the bottom three vote getters is announced, without disclosing the actual tallies. The lowest vote getter is then eliminated from the following week's competition.

One problem with the current voting system is that there appears to be irregularity in some of the voting patterns from week to week. Some changes are to be expected as some contestants give stronger relative performances one week compared with another. However, some voting results appear to be suggest that many call in voters are voting based on popularity of the contestant rather than singing skills, as evidenced by voting tallies that are sometimes completely inconsistent with the judges assessment of each contestants' performance. Some voting irregularity may also be due to some complacency of viewers who assume that the better singers don't need their voting support in order to remain in the competition, particularly if those singers have consistently avoided being amongst the bottom three vote getters from prior weeks. Some irregularity may also result from many viewers only seeing part of the show, and thus not being able to make valid comparisons amongst the singers. Some may be due to the fact that the order of singers is different every week, or the correct dial in numbers could be confused. Perhaps the manner in which the judges rate the singers or the manner in which the host reviews each singer's performance immediately before the dial-in number is announced on the television screen may bias voters in different directions during different weeks of the competition. Further voting inconsistencies from week to week may result from different viewers watching the show, perhaps because of competing shows on other networks, or because of conflicts during the two hour call-in period following the show which inhibit potential voters from calling in during a particular week. Perhaps the greatest risk of voting inconsistencies could stem from organized attempts to sabotage the show's results by encouraging voting for the least talented remaining competitor, which appears to be the stated mission of the web site votefortheworst.com.

OBJECTS AND ADVANTAGES

The TELEVISED COMPETITION VIEWER VOTING MODIFIED SCORING METHODOLOGY (which will be referred to hereafter as "tv mod-score method") described herein addresses many of these potential sources of voting irregularities by taking into account the voting results of two or more shows, thereby lessening the impact of irregularities that might occur during one particular week. This lessens the chance that random fluctuations in circumstances or imperfections in the voting system might result in the dismissal of a contestant who has been consistently amongst the highest vote getters, but then becomes the lowest vote getter in one single week, perhaps for reasons that are not fully understood by anyone. Lessening the chance of this happening, as it did recently for Latoya London on American Idol, could help this show, and perhaps other popular shows as well, retain their credibility with their audience and thus maintain their popularity or even their very survival.

SUMMARY

A method of tabulating votes from the viewing audience of a "Reality TV" show which also takes into account said votes from previous weeks' shows in order to determine the success or failure of each of the show's contestants in a way that will reward contestants more for good performance over multiple shows and penalize them less for poor performance during a single show.

DRAWINGS

FIG. 1 is a matrix containing voting results for a hypothetical 11 week competition of American Idol, during which the one singer with the lowest percentage of the total votes is voted off during each of the 11 weeks, leaving one of the original 12 as the winner. The order of finish of the 12 contestants is indicated in the first column labeled 102.

FIG. 2 contains two matrices, each illustrating the same hypothetical week as illustrated in FIG. 1, but employing a modified scoring methodology against the voting tallies. The top matrix 210 shows the new order of contestant finishes 202 that result from this modified scoring. The raw, unmodified voting percentages are still contained within the body of matrix 210. The bottom matrix 220 also contains the new order of finishes amongst contestants 206, but contains the modified voting results within the body of the matrix. The modified voting percentages are determined from the individual voting tallies from multiple weeks, as will be explained in more detail in the next section.

DETAILED DESCRIPTION—PREFERRED EMBODIMENT

The tv mod-score method consists of a system of tallying votes from one or more weeks' voting periods, such number depending on which week of the competition the votes are being tallied for, after weighting all such votes by factors that are a function of which week such votes were cast. This could be done as follows:

First, the raw voting results to include in any given week could be set as follows:

- The scoring for week 2 will take into account the raw voting results for weeks 1 and 2.
- The scoring for week 3 will take into account the raw voting results for weeks 1 through 3.
- The scoring for weeks 4 through 8 will take into account the raw voting results for the current week and the prior 3 weeks.
- The scoring for week 9 will take into account the raw voting results for weeks 7 through 9.
- The scoring for week 10 will take into account the raw voting results for weeks 9 and 10.
- The scoring for weeks 1 and 11 will take into account only the raw voting results for the current week.

Next, the raw votes themselves could be weighted by factors before tallying them up, as follows:

- For those weeks where only the current week's raw scores are utilized, the raw scores are weighted by a factor of 1
- For those weeks where both the current and prior week's raw scores are utilized, the current week's raw scores are weighted by a factor of ⅔ and the prior week's raw scores are weighted by a factor of ⅓.
- For those weeks where the current and 2 prior week's raw scores are utilized, the current week's raw scores are weighted by a factor of ⅜, the prior week's raw scores are weighted by a factor of ⅜ and the second prior week's raw scores are weighted by a factor of ⅙.
- For those weeks where the current and 3 prior week's raw scores are utilized, the current week's raw scores are weighted by a factor of 4/10, the prior week's raw scores are weighted by a factor of 3/10, the second prior week's raw scores are weighted by a factor of 2/10, and the third prior week's scores are weighted by a factor of 1/10.

The weighted raw scores for any given week are then totaled up to determine the ranking of all remaining contestants, with the lowest ranking contestant leaving the competition during the current week. This modified scoring system could, in many cases, particularly where the ranked order of the raw voting totals changes significantly from one week to the next, result in the contestant with the lowest number of votes for any given week remaining in the competition, while a higher vote getter for the current week is required to leave because of lower voting results from prior weeks relative to the contestant who would otherwise be required to leave, and perhaps relative to other contestants as well.

Operation—FIGS. 1, 2

FIGS. 1 and 2 illustrate the voting results for a hypothetical 11 week competition with 12 contestants. FIG. 1 illustrates the current simplified scoring methodology employed by the American Idol television series. The raw voting tallies for each week, expressed as percentages, are shown in matrix form. The rows of the matrix are ordered in the same order of how all the contestants finished in the competition, as illustrated in phantom 102. For example, contestant 12 was the first eliminated in week 1 with only 2.8% of the total vote, contestant 11 was eliminated the next week with 2.8% of the vote, contestant 8 the third week with 7.2% of the vote, while contestant 3 won the competition receiving 53.1% of the vote during the final week.

FIG. 2 illustrates how this same competition would have unfolded if the modified scoring system described in the DETAILED DESCRIPTION section above were applied to the same raw voting totals. The top matrix 210 of FIG. 2 illustrates the same raw voting percentages, but with two differences. First, the rows of the matrix are reordered according to the new order of finish that would be dictated by application of the tv mod-score method referred to above. Then, in those weeks in which the order of finish has been altered by the new scoring method, phantom 204 indicates which contestant was eliminated by which other contestant as a result of the change in scoring methodology. For example, in week 3, contestant 8 had the lowest raw voting total (7.2%) but was able to finish ahead of contestant 10 who had a higher raw voting total (8.0%). Hence, the expression "10 by 8" in phantom 204 indicates that contestant 10 was eliminated by contestant 8 due to the new scoring method. Assuming this revised scoring method had been in place and that contestant 10 had actually been eliminated instead of contestant 8, then contestant 8 is deemed to receive contestant 10's votes in all remaining weeks of the competition (for purposes of assessing the potential impact of applying such revised scoring methodology).

The bottom matrix of FIG. 2 illustrates the application of the new modified scoring system, whereas the top matrix 210 still includes just the raw voting totals. For example, in week 3, contestant 10's modified score is 6.1%, which is calculated from (8.0%×⅜)+(3.7%×⅜)+(4.4%×⅙). Contestant 8's modified score is 7.9%, which is calculated from (7.2%×⅜)+(9.9%×⅜)+(6.1%×⅙). This illustrates how contestant 8 was able to move ahead of contestant 10 in the third week despite a lower raw voting total that week. The modified scoring system is similarly applied in all other weeks according to the parameters described in the DETAILED DESCRIPTION section, so that for weeks 4 through 8, raw voting totals are utilized from the current and 3 prior weeks, while for other weeks a lesser number of weeks' votes are utilized. Only during the competition's first and last weeks (1 and 11) are only the current week's raw votes utilized.

The application of this tv mod-score method would have caused contestant number 1 to finish $6^{th}$ instead of $2^{nd}$, as it had several sub-par votes during weeks 4 through 7 that would have caused it to be eliminated, even though it never had the lowest raw vote in any single week. It also would have allowed contestant 6 to finish $4^{th}$ instead of $9^{th}$. Contestant 6 was able to survive until week 9 even though it had the lowest raw voting totals in both weeks 4 and 8, because it had consistently strong performances in several other weeks for which the tv mod-score method gave credit. These type of modified results may be deemed a fairer and/or more desirable outcome by the producers of the show, possibly because they may feel that their collective viewers would like to see consistent performers rewarded and not have the competitors' fate ride on a single night's votes. By employing the tv mod-score method and choosing the relevant parameters to take into account past performances to the desired degree, show producers can enhance the value of their show and make it more popular amongst their viewers, and perhaps avoid unwanted scenarios in which very popular or talented performers are voted off as the result of a single week's low voting total.

Additional Embodiments

Several aspects of the tv mod-score method could be varied to create the desired amount of emphasis on both prior and current weeks' raw voting totals. These include:

1. The number of prior weeks to include. The tv mod-score method described above uses a maximum of 3 prior weeks, but it could use as many as 10 prior weeks in an 11 week competition.
2. The relative weights applied to both current and prior week raw voting totals. The mod-score method described above gives a greater weight to the more recent weeks' votes (e.g., 40%, 30%, 20%, and 10% for the past 4 weeks). Other factors could also give more weight to the current week's vote, but equal weight to prior weeks' votes (e.g., 60%, 20%, 20%, 20%).
3. Adjustments could be made to adjust for unequal numbers of total number of votes each week. For example, if every week had 1,000,000 votes cast except the current week, which had only 900,000, then the current week's votes might all be multiplied by 10/9 before the individual raw totals are weighted and totaled. This type of adjustment might prevent a particular week's votes being over or underweighted due to unusual voting totals in such weeks.
4. Each contestant's raw votes for a given week might be converted to the contestant's rank for that week, with individual weights then applied to each week's rank. For example, if contestant #1 finished first, fifth, sixth, and second for each of past four weeks when ranked by raw voting totals, then their modified score could be calculated as (40%×1)+(30%×5)+(20%×6)+(10%×2)=3.3. Using this method, the contestant with the highest modified score would be deemed to finish last and leave the competition.
5. Each contestant's raw votes for a given week might be converted to the contestant's rank for that week expressed by which ordered group the contestant finished in that week. For example, each contestant's raw totals for each week might be ranked in terms of whether they fell in the top third, middle third, or bottom third. Those finishes could then be weighted in the same manner as earlier examples. For example, if a contestant's last four finishes were bottom third, middle third, top third and top third, respectively, then their modified score could be calculated as (40%×3)+(30%×2)+(20%×1)+(10%×1)=2.1. Using this method, the contestant with the highest modified score would be deemed to finish last and leave the competition.

Other methods of modification and weighting are possible. The producers of the show must select from a variety of combinations of factors which provide the proper emphasis on votes over a series of weeks that rewards both recent performance as well as consistent performance.

CONCLUSIONS, RAMIFICATIONS, AND SCOPE

Thus the reader will see that the tv mod-score method described herein has the potential to materially alter the results of a widely viewed televised contest by scoring the contest in a systematically different manner than is currently done, but with such alteration skewing the results in a direction that will be likely be more popular with the viewing audience than it otherwise might be. It does this by factoring in previous or cumulative voting results in addition to current voting results, thereby diminishing the uncertain and potentially negative impact that voting irregularities and inconsistencies from one show to the next might have on the competition's outcome. The potential causes and sources of these inconsistencies which can threaten the integrity of the competition, and therefore the show itself, are varied and difficult to account for with great accuracy, yet the tv mod-score method could be an effective immunizing shield against all those threats as it directly remedies the effects of those inconsistencies regardless of the underlying cause.

While the above description contains many specificities, these should not be construed as limitations on the scope of the invention, but rather an exemplification of one preferred embodiment thereof. Other variations are possible. For example, how many previous raw voting totals should be included, and exactly how they are weighted relative to each other, are key considerations that ultimately will be somewhat subjective, and perhaps dependent on other variables, such as how many contestants either started in, or still remain in the competition. The Additional Embodiments section above described some of the potential variations that might be deemed improvements over other embodiments, in addition to adding value relative to unmodified voting totals.

Accordingly, the scope of the invention should be determined not by the embodiment(s) illustrated, but by the appended claims and their legal equivalents.

I claim:

1. A method of totaling votes relating to a competition amongst a plurality of contestants, said competition having two or more voting sessions, comprising:

(a) compiling raw voting totals for a current session of said voting sessions for said competition for each contestant still remaining in said competition, (b) compiling raw voting totals for a predetermined number of said voting sessions occurring prior to said current voting session for said competition for each said contestant still remaining in said competition as of said current voting session, (c) converting each said raw voting totals for each of said contestants into a score for each of said voting totals for each said contestant, (d) weighting each of said scores with predetermined weights, (e) summing each of said weighted score for each of said remaining contestants, (f) ranking each of said summed weighted scores for each of said remaining contestants from highest to lowest, whereby said method yields said ranked weighted scores that can be more useful in judging success or failure of said contestants in said competition than said raw voting totals for said current voting session alone, and whereby said ranked weighted scores may be deemed by observers of said competition to be fairer than said raw voting totals for said current voting session alone, and whereby said method will be expected to result in higher popularity of said competition amongst said observers.

2. The method of claim 1 wherein the conversion is being determined by a predetermined algorithm that is specific to said competition.

3. The method of claim 2 wherein the predetermined algorithm is specific to a number of remaining contestants in a competition.

4. The method of claim 1 wherein the weights are determined by a predetermined algorithm that is specific to said competition.

5. The method of claim 4 wherein the predetermined algorithm is specific to a number of remaining contestants in a competition.

6. A method of totaling votes relating to a competition amongst a plurality of contestants, said competition having two or more voting sessions, comprising:

(a) totaling votes for current a session of said voting sessions for said competition for each contestant still remaining in said competition, (b) totaling votes for a predetermined number of said voting sessions occurring prior to said current voting session for said competition for each said contestant still remaining in said competition as of said current voting session, (c) weighting each of said voting totals with predetermined weights, (d) summing each of said weighted voting totals for each of said remaining contestants, (e) ranking each said summed weighted voting totals for each said remaining contestant from highest to lowest, whereby said method yields said ranked weighted voting totals that can be more useful in judging success or failure of said contestants in said competition than said raw voting totals for said current voting session alone, and whereby said ranked weighted voting totals may be deemed by observers of said competition to be fairer than said raw voting totals for said current voting session alone, and whereby said method will be expected to result in higher popularity of said competition amongst said observers.

* * * * *